US010325563B2

(12) United States Patent
Guo et al.

(10) Patent No.: US 10,325,563 B2
(45) Date of Patent: Jun. 18, 2019

(54) CIRCUIT AND METHOD FOR ELIMINATING IMAGE STICKING DURING POWER-ON AND POWER-OFF

(71) Applicants: BOE TECHNOLOGY GROUP CO., LTD., Beijing (CN); BEIJING BOE DISPLAY TECHNOLOGY CO., LTD., Beijing (CN)

(72) Inventors: Rui Guo, Beijing (CN); Zongze He, Beijing (CN); Zhiming Meng, Beijing (CN); Weihao Hu, Beijing (CN); Yanping Liao, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 205 days.

(21) Appl. No.: 15/515,777

(22) PCT Filed: Jul. 13, 2016

(86) PCT No.: PCT/CN2016/089925
§ 371 (c)(1),
(2) Date: Mar. 30, 2017

(87) PCT Pub. No.: WO2017/117963
PCT Pub. Date: Jul. 13, 2017

(65) Prior Publication Data

US 2018/0330684 A1 Nov. 15, 2018

(30) Foreign Application Priority Data

Jan. 5, 2016 (CN) ..... 2016 1 0007090

(51) Int. Cl.
*G09G 3/36* (2006.01)

(52) U.S. Cl.
CPC ..... *G09G 3/3655* (2013.01); *G09G 3/36* (2013.01); *G09G 3/3614* (2013.01);
(Continued)

(58) Field of Classification Search
CPC .. G09G 3/3648; G09G 3/3655; G09G 3/3696; G09G 2320/0257; G09G 2330/02; G09G 2330/026; G09G 2330/027
See application file for complete search history.

(56) References Cited

U.S. PATENT DOCUMENTS 6,476,590 B2 11/2002 Chou
8,836,684 B2 * 9/2014 Harada ..... G09G 3/3655 345/211

(Continued)

FOREIGN PATENT DOCUMENTS

CN 101399014 A 4/2009
CN 101546536 A 9/2009

(Continued)

OTHER PUBLICATIONS

The First Chinese Office Action dated Oct. 11, 2017; Appln. 201610007090.6.

(Continued)

*Primary Examiner* — Vijay Shankar
(74) *Attorney, Agent, or Firm* — Ladas & Parry LLP

(57) ABSTRACT

A circuit and method for eliminating image sticking during power-on and power-off, the circuit for eliminating image sticking during power-on and power-off includes a voltage detecting module and a common signal writing module; the voltage detecting module detects whether an operating voltage is lower than a first threshold voltage during power-on, and detects whether the operating voltage is lower than a second threshold voltage during power-off; and the common signal writing module writes, when the operating voltage is (Continued)

lower than the first threshold voltage during power-on or the operating voltage is lower than the second threshold voltage during power-off, a signal with a voltage equal to a voltage at a common voltage signal terminal at the same timing, to a data line.

19 Claims, 4 Drawing Sheets

(52) U.S. Cl.
CPC ..... *G09G 2320/0247* (2013.01); *G09G 2330/026* (2013.01); *G09G 2330/027* (2013.01)

(56) References Cited

U.S. PATENT DOCUMENTS 8,984,142 B2 * 3/2015 Dickerson ..... H04L 63/083 709/217
9,767,758 B2 * 9/2017 Sun ..... G09G 3/3648
10,062,349 B2 * 8/2018 Choi ..... G09G 3/3696
2001/0011979 A1 8/2001 Hasegawa et al.
2011/0102405 A1 5/2011 Harada
2011/0310135 A1 12/2011 Feng
2015/0379954 A1 12/2015 Choi et al.
2016/0365056 A1 12/2016 Sun et al.

FOREIGN PATENT DOCUMENTS

CN 102290032 A 12/2011
CN 104361866 A 2/2015
CN 105185289 A 12/2015
CN 105185293 A 12/2015
CN 105632435 A 6/2016
JP 4289582 A 5/2009
JP 2011-095622 A 5/2011

OTHER PUBLICATIONS

International Search Report and Written Opinion dated Oct. 20, 2016; PCT/CN2016/089925.

* cited by examiner

CIRCUIT AND METHOD FOR ELIMINATING IMAGE STICKING DURING POWER-ON AND POWER-OFF

CROSS-REFERENCE TO RELATED APPLICATIONS

The present application claims the benefit of priority right of Chinese patent application with the application No. 201610007090.6, filed on Jan. 5, 2016 in China, which is incorporated by reference herein in its entirety.

TECHNICAL FIELD

The present disclosure relates to the field of display technique, and, more particularly, to a circuit for eliminating image sticking during power-on and power-off and a method for eliminating image sticking during power-on and power-off.

BACKGROUND

FIG. 1 is a schematic diagram of a liquid crystal display device in the related art. As illustrated in FIG. 1, the liquid crystal display device includes a backlight source 1 and a display panel 2; wherein the backlight source 1 provides light; the display panel 2 typically includes an array substrate 20 and a color-film substrate 21, the array substrate 20 and the color film substrate 21 are celled, and a liquid crystal layer 22 is arranged therebetween; pixel electrodes and common electrodes are arranged on the array substrate 20 (the common electrode can also be arranged on the color-film substrate). In the display process, an electric field for deflecting liquid crystal molecules in the liquid crystal layer is generated by writing data signals to the pixel electrodes and writing a common voltage signal VCOM to the common electrodes, separately, so that when the light emitted from the backlight source 1 passes through respective areas of the liquid crystal layer 22 to form the corresponding transmittance, thereby achieving displaying.

During power-on and power-off of the liquid crystal display device, the timing at which the common voltage signal VCOM is applied to the common electrodes and the timing at which the data signal VDATA is applied to the pixel electrode are inconsistent. Taking the case of power-off as an example, the timing of the common voltage signal VCOM and the timing of the data signal VDATA are illustrated in FIG. 2. The difference in the timing will cause a voltage difference to occur between the pixel electrode and the common electrode, so that the liquid crystal molecules are polarized during power-on and power-off, which results in defects such as image sticking and flicker, affects a quality of display, and meanwhile leads to a reduction in the lifespan of components in the display device.

SUMMARY

In view of the above, the present disclosure provides a circuit and method for eliminating image sticking during power-on and power-off, said circuit and method can eliminate the voltage difference between the pixel electrode and the common electrode during power-on and power-off, so as to avoid defects such as image sticking and flicker.

In an aspect, the present disclosure provides a circuit for eliminating image sticking during power-on and power-off, and the circuit is configured to make the timing of a signal on the data line and that of a signal at the common voltage signal terminal of the display panel consistent during power-on and/or power-off, the circuit for eliminating image sticking during power-on and power-off comprises a voltage detecting module and a common signal writing module; the voltage detecting module is configured to detect whether an operating voltage is lower than a first threshold voltage during power-on, and detect whether the operating voltage is lower than a second threshold voltage during power-off; and the common signal writing module is configured to, when the operating voltage is lower than the first threshold voltage during power-on or the operating voltage is lower than the second threshold voltage during power-off, write a signal, which has a voltage equal to a voltage at a common voltage signal terminal at the same timing, to a data line.

Optionally, the voltage detecting module is a Xao (X-driver all open) module.

Optionally, the common signal writing module comprises a wire connecting the data line to the common voltage signal terminal, and a switch arranged on the wire; the switch enables the path between the data line and the common voltage signal terminal to conduct when the voltage detecting module detects that the operating voltage is lower than the first threshold voltage during power-on; and the switch enables the path between the data line and the common voltage signal terminal to conduct when the voltage detecting module detects that the operating voltage is lower than the second threshold voltage during power-off.

Optionally, the switch is a thin film transistor, a gate of the thin film transistor is connected to the Xao module, a source of the thin film transistor is connected to the common voltage signal terminal, and a drain of the thin film transistor is connected to the data line.

Optionally, the common signal writing module further comprises a resistor and a capacitor; the resistor is arranged between the common voltage signal terminal and the source of the thin film transistor; a first terminal of the capacitor is connected to one terminal of the resistor and the source of the thin film transistor, and a second terminal of the capacitor is grounded.

Optionally, the common signal writing module further comprises a timing controller; when the voltage detecting module detects that the operating voltage is lower than the first threshold voltage during power-on or detects that the operating voltage is lower than the second threshold voltage during power-off a first-level control signal is inputted to the timing controller, wherein the first-level control signal is a digital signal; the timing controller inputs a second-level control signal to a data signal terminal according to the first-level control signal, wherein the second-level control signal is an analog signal, which has a voltage equal to the voltage at the common voltage signal terminal at the same timing; and the data signal terminal inputs a data signal, which has a voltage equal to the voltage at the common voltage signal terminal at the same timing, to the data line according to the second-level control signal.

Optionally, the voltage detecting module further comprises a timer; the timer is configured to calculate a time length for which the operating voltage is lower than the first threshold voltage during power-on, and calculate a time length for which the operating voltage is lower than the second threshold voltage during power-off; when the time length for which the operating voltage is lower than the first threshold voltage during power-on reaches a first preset time length, or when the time length for which the operating voltage is lower than the second threshold voltage during power-off reaches a second preset time length, the voltage detecting module sends a signal to the common signal writing module, so that the common signal writing module starts to write a signal to the data line.

Optionally, values of the first preset time length and the second preset time length both are in a range of 5 milliseconds to 1 second.

In another aspect, the present disclosure further provides a method for eliminating image sticking of a display device during power-on, comprising:

K1, detecting an operating voltage during power-on;

K2, when the operating voltage is lower than the first threshold voltage, writing to a data line a signal, which has a voltage equal to a voltage at a common voltage signal terminal at the same timing;

and/or

G1, detecting an operating voltage during power-off; and

G2, writing to a data line a signal, which has a voltage equal to a voltage at a common voltage signal terminal at the same timing, when the operating voltage is lower than a second threshold voltage.

Optionally, in step K2, when a time length for which the operating voltage is lower than the first threshold voltage reaches a first preset time length, a signal, which has a voltage equal to the voltage at the common voltage signal terminal at the same timing, is written to the data line.

Optionally, in step G2, when a time length for which the operating voltage is lower than the second threshold voltage reaches a second preset time length, a signal, which has a voltage equal to the voltage at the common voltage signal terminal at the same timing, is written to the data line.

Optionally, in step K2, the path between the data line and the common voltage signal terminal conducts.

Optionally, in step G2, the path between the data line and the common voltage signal terminal conducts.

Optionally, the step K2 comprises:

K21, inputting a first-level control signal to a timing controller;

K22, inputting, by the timing controller, to the data signal terminal a second-level control signal, wherein a voltage of the second-level control signal is equal to the voltage at the common voltage signal terminal at the same timing; and K23, inputting, by the data signal terminal, to the data line a data signal, which has a voltage equal to the voltage at the common voltage signal terminal voltage at the same timing.

Optionally, the step G2 comprises:

G21, inputting a first-level control signal to a timing controller;

G22, inputting, by the timing controller, to a data signal terminal a second-level control signal, wherein a voltage of the second-level control signal is equal to a voltage at the common voltage signal terminal at the same timing; and G23, inputting, by the data signal terminal, to the data line a data signal, which has a voltage equal to the voltage at the common voltage signal terminal at the same timing.

Optionally, values of the first preset time length and the second preset time length both are in a range of 5 milliseconds to 1 second.

Optionally, the first-level control signal is a digital signal, and the second-level control signal is an analog signal.

The circuit and method in the present disclosure have the following advantageous effects:

In the circuit for eliminating image sticking during power-on and power-off provided by the present disclosure, by writing to the data line a signal, which has a voltage equal to the voltage at the common voltage signal terminal at the same timing, during power-on and power-off, the voltage at the common electrode and the voltage at the pixel electrode can be made equal to each other, eliminating a voltage difference there between, and thus the liquid crystal molecules are prevented from being polarized and the image sticking and flicker are avoided, accordingly, the quality of display can be improved, and the lifespan of components in the display device can be extended.

In the method for eliminating image sticking during power-on and power-off provided by the present disclosure, a signal, which has a voltage equal to the voltage at the common voltage signal terminal at the same timing, is written to the data line, so that when the operating voltage is lower than the first threshold voltage during power-on or when the operating voltage is lower than the second threshold voltage during power-off, the voltage at the common electrode and the voltage at the pixel electrode are made equal to each other, a voltage difference there between can be eliminated, thereby preventing the liquid crystal molecules from being polarized and avoiding the image sticking and flicker; accordingly, the quality of display can be improved, and the lifespan of components in the display device can be extended.

BRIEF DESCRIPTION OF THE DRAWINGS

In order to more clearly illustrate the technical solutions of the embodiments of the present disclosure, hereinafter, the drawings necessary for illustration of the embodiments of the present application will be introduced briefly, the drawings described below only illustrate some embodiments of the present disclosure, and it is possible for those skilled in the art to obtain other drawings based on these drawings without paying creative efforts. The following drawings are focused on illustrating the subject matter of the present application, not schematically scaled by actual dimensions.

DETAILED DESCRIPTION OF THE EMBODIMENTS

Hereinafter, some embodiments of the present disclosure will be described clearly and comprehensively in combination with the drawings of some embodiments of the present disclosure. Obviously, these described embodiments are merely parts of the embodiments of the present disclosure, rather than all of the embodiments thereof. Other embodiments obtained by a person of ordinary skill in the art based on the embodiments of the present disclosure without paying creative effort all fall into the protection scope of the present disclosure.

Unless otherwise defined, technical terms or scientific terms used herein shall have common meaning known to those skilled in the art of the present disclosure. Terms and expressions such as "first", "second" and the like used in the specification and claims of the present disclosure do not mean any sequence, quantity or significance, but for distinguishing between different components. Likewise, terms such as "a", "an", "the" and the like do not denote quantitative restrictions, but denote the presence of at least one. Terms such as "connected", "connecting" and the like are not restricted to physical or mechanical connections, but can include electrical connections, regardless of direct or indirect connections. Terms such as "up", "below", "left", "right", etc., are only used to denote relative positional relationship, and once an absolute position of the described object changes, the relative positional relationship can be probably changed correspondingly.

The present disclosure provides a circuit for eliminating image sticking during power-on and power-off. The circuit for eliminating image sticking during power-on and power-off can make the timing of the signal on the data line and that of the signal on the common voltage signal terminal of the display panel consistent during power-on and/or power-off. The circuit for eliminating image sticking during power-on and power-off comprises a voltage detecting module and a common signal writing module; the voltage detecting module is configured to detect whether an operating voltage is lower than a first threshold voltage during power-on, and to detect whether the operating voltage is lower than a second threshold voltage during power-off; and the common signal writing module is configured to, when the operating voltage is lower than the first threshold voltage during power-on or the operating voltage is lower than the second threshold voltage during power-off, write a signal, which has a voltage equal to a voltage at a common voltage signal terminal at the same timing, to a data line.

Figure 1:
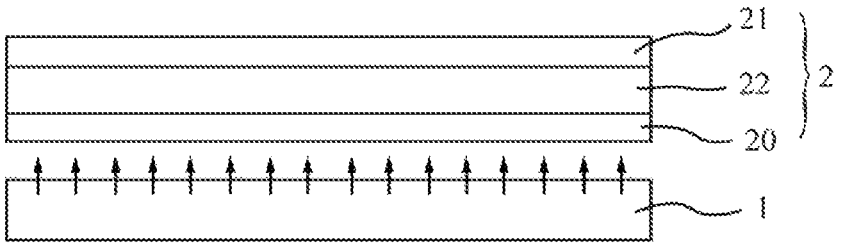
FIG. 1 is a schematic diagram of a liquid crystal display device in the related art.
Figure 2:
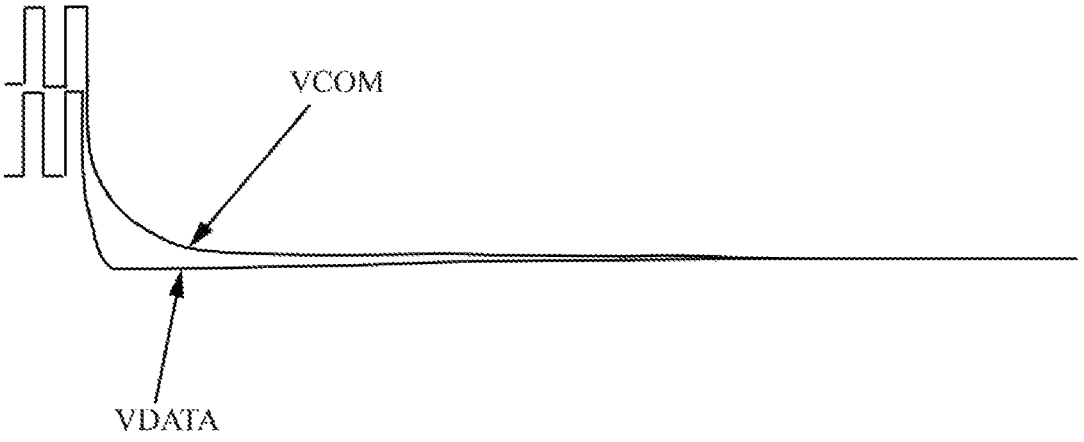
FIG. 2 is a schematic diagram illustrating the timing of the common voltage signal VCOM and the timing of the data signal during power-off in the related art.
Figure 3:
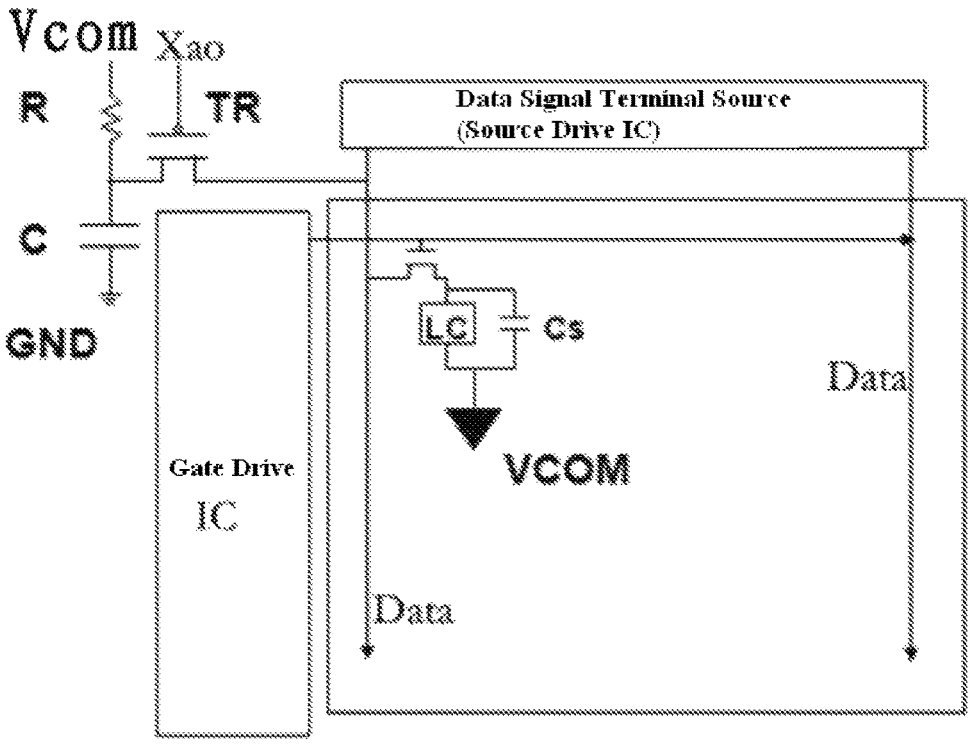
FIG. 3 is a circuit diagram of a circuit for eliminating image sticking during power-on and power-off in some embodiments of the present disclosure.

FIG. 3 is a circuit diagram of a circuit for eliminating image sticking during power-on and power-off in some embodiments of the present disclosure. As illustrated in FIG. 3, in the implementation, the voltage detecting module is a Xao (X-driver all open) module. The common signal writing module comprises a wire connecting the data line and the common voltage signal terminal, and a switch arranged on the wire; the switch enables the path between the data line and the common voltage signal terminal conduct when the voltage detecting module detects that the operating voltage is lower than the first threshold voltage during power-on of the display device; and the switch enables the path between the data line and the common voltage signal terminal conduct when the voltage detecting module detects that the operating voltage is lower than the second threshold voltage during power-off.

The Xao module detects a magnitude of the operating voltage VDD during power-on and power-off; specifically, during power-on, the Xao module outputs a low level when the operating voltage VDD is lower than the first threshold voltage, and the Xao module outputs a high level when the operating voltage VDD is higher than the first threshold voltage; during power-off, the Xao module outputs a low level when the operating voltage VDD is lower than the second threshold voltage, and the Xao module outputs a high level when the operating voltage VDD is higher than the second threshold voltage. In practice, the first threshold voltage can be equal to the second threshold voltage as needed.

The switch can be a thin film transistor TR in particular, for example, the thin film transistor TR is a P-type transistor, wherein a gate of the thin film transistor TR is connected to the Xao module, a source of the thin film transistor TR is connected to the common voltage signal terminal Vcom, and a drain of the thin film transistor TR is connected to the data line Data. Specifically, the common signal writing module further comprises a resistor R and a capacitor C; one terminal of the resistor R is connected to the common voltage signal terminal Vcom, and the other terminal of the resistor R is connected to the source of the thin film transistor TR and a first terminal of the capacitor C; the first terminal of the capacitor C is further connected to the source of the thin film transistor TR, and a second terminal of the capacitor C is grounded.

During power-on, the operating voltage VDD is gradually increased from zero to a normal voltage, and the first threshold voltage is lower than the normal voltage of the operating voltage VDD; in particular, the first threshold voltage is a voltage which is set lower than the normal voltage of the operating voltage VDD, for example, the first threshold voltage can be set to 9V or 12V if the normal voltage of the operating voltage VDD is 30V. Thus, in a first period of power-on, the operating voltage VDD is lower than the first threshold voltage, and the Xao module outputs a low level, so that the thin film transistor TR is turned on, the path between the data line Data and the common voltage signal terminal Vcom conducts, and the common voltage signal VCOM is input to each of data lines Data from the common voltage signal terminal Vcom while the common voltage VCOM is input to the common electrodes. When the pixel is turned on, the common voltage signal VCOM is written into the pixel electrode, thus, in this period, there is no voltage difference between the common electrode and the pixel electrode, and the pixel polarization can be avoided, and in turn the image sticking and flicker can be avoided, the quality of display can be improved, and the lifespan of components in the display device can be extended.

In a second period of power-on, the operating voltage VDD is higher than the first threshold voltage, the Xao module outputs a high level, so that the thin film transistor TR is turned off, the path between the data line Data and the common voltage signal terminal Vcom is cut, the data signal DATA is input to each of data lines from the data signal terminal Source, and the data signal DATA is written into the pixel electrode when the pixel is turned on. In this way, the common voltage signal VCOM is written into the common electrode, and the data signal DATA is written into the pixel electrode, so that an electric field for deflecting the liquid crystal molecules can be generated according to the common voltage VCOM and the data signal DATA, thereby displaying is realized.

During power-off, the operating voltage VDD is gradually decreased from a normal voltage to zero. In a first period, the operating voltage VDD is higher than the second threshold voltage, and the second threshold voltage is set in a manner similar to that of the first threshold voltage; the second threshold voltage can be equal to the first threshold voltage, and of course, the second threshold voltage can be different from the first threshold voltage. The Xao module outputs a high level, the thin film transistor TR remains in a tuned-off state, and the normal data signal DATA is input to each data line Data by the data signal terminal Source, that is, in this period, the normal displaying is still maintained. In a second period, the operating voltage VDD is lower than the second threshold voltage, and the Xao module outputs a low level, so that the thin film transistor TR is turned on, and the path between the data line Data and the common voltage signal terminal Vcom conducts; afterthat, the common voltage signal VCOM is input to each data line Data by the common voltage signal terminal Vcom while the common voltage signal VCOM is input to the common electrode. When the pixel is turned on, the common voltage signal VCOM is written into the pixel electrode. Thus, in this period, there is no voltage difference between the common electrode and the pixel electrode, the pixel polarization can be avoided, and further, the image sticking and flicker can be avoided, the quality of display can be improved, and the lifespan of components in the display device can be extended.

To sum up, in some embodiments of the present disclosure, by conducting the path between the data line Data and the common voltage signal terminal Vcom during power-on and power-off, so that the voltage at the common electrode and the voltage at the pixel electrode are equal to each other, the voltage difference therebetween are eliminating, the pixel polarization can be avoided, and further, the image sticking and flicker can be avoided, the quality of display can be improved, and the lifespan of components in the display device can be extended.

Figure 4:
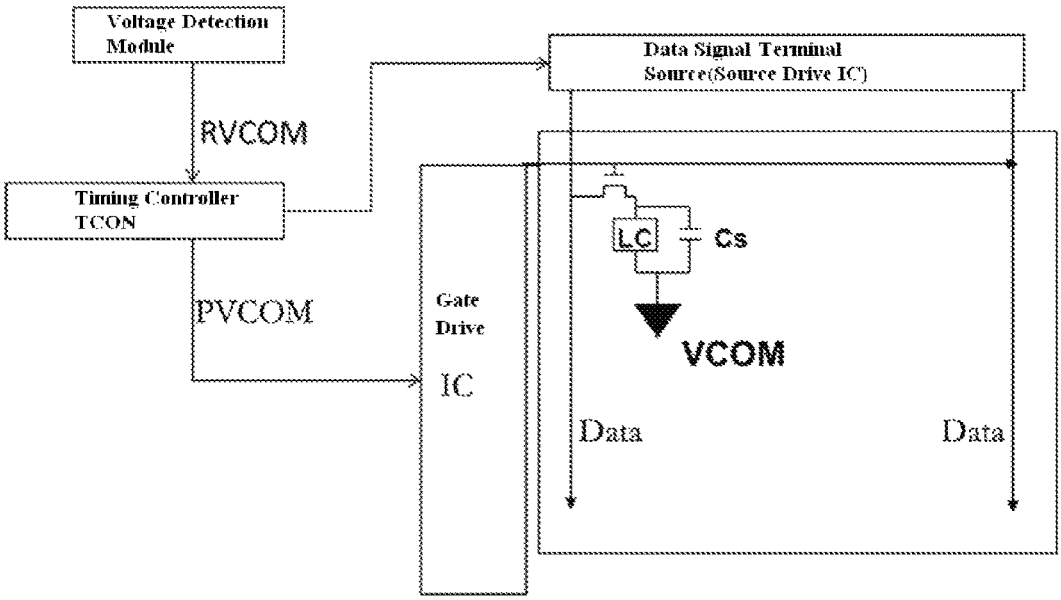
FIG. 4 is a circuit diagram of another circuit for eliminating image sticking during power-on and power-off in some embodiments of the present disclosure.

Referring to FIG. 4, FIG. 4 is a circuit diagram of another circuit for eliminating image sticking during power-on and power-off in some embodiments of the present disclosure. Different from the circuit for eliminating image sticking during power-on and power-off described above with reference to FIG. 3, in the circuit for eliminating image sticking during power-on and power-off illustrated in FIG. 4, the common signal writing module comprises a timing controller ICON, and in this implementation, the voltage of the signal on the data line Data is made equal to the voltage at the common voltage signal terminal Vcom by controlling the data signal DATA outputted by the data signal terminal Source via the timing controller TCON; in this process, the data line Data and the common voltage signal terminal Vcom are not connected.

Specifically, when the voltage detecting module (the Xao module) detects that the operating voltage VDD is lower than the first threshold voltage during power-on or detects that the operating voltage VDD is lower than the second threshold voltage during power-off, a first-level control signal RVCOM is inputted to the timing controller TCON, wherein the first-level control signal RVCOM is a digital signal; the timing controller TCON inputs a second-level control signal PVCOM to the data signal terminal Source according to the first-level control signal RVCOM, wherein the second-level control signal PVCOM is an analog signal, which has a voltage equal to the voltage at the common voltage signal terminal Vcom at the same timing; and the data signal terminal Source inputs a data signal DATA, which has a voltage equal to the voltage at the common voltage signal terminal Vcom at the same timing, to the data line Data according to the second-level control signal PVCOM.

The voltage of the first-level control signal RVCOM can be equal to the voltage at the common voltage signal terminal Vcom at the same timing; in the timing controller TCON, after being converted by a Digital-to-Analog Converter (DAC), the first-level control signal RVCOM is converted into an analog signal, that is, the second-level control signal PVCOM, wherein the voltage of the second-level control signal PVCOM is also equal to the voltage at the common voltage signal terminal Vcom at the same timing. The data signal terminal Source generates the data signal DATA, which has a voltage that is equal to the voltage at the common voltage signal terminal Vcom at the same timing, according to the second-level control signal PVCOM, and inputs the same to the data line Data. In this process, the data signal terminal Source can also perform digital-to-analog conversion to the second-level control signal PVCOM, so as to amplify the signal, and improve load capability.

Optionally, the voltage detecting module further comprises a timer configured to calculate a time length for which the operating voltage is lower than the first threshold voltage during power-on, and calculate a time length for which the operating voltage is lower than the second threshold voltage during power-off; when the time length for which the operating voltage is lower than the first threshold voltage during power-on reaches a first preset time length, or when the time length for which the operating voltage is lower than the second threshold voltage during power-off reaches a second preset time length, the voltage detecting module sends a signal to the common signal writing module, so that the common signal writing module starts to write a signal to the data line. In this way, it is possible to avoid malfunction due to the jitter of the operating voltage VDD, which might be identified as a power-on or power-off process, during the normal displaying, thus enhancing the system robustness. Specifically, the value of the first preset time length and that of the second preset time length can be set according to the needs, and the specific values can be a millisecond order or more, for example, 5 ms to 1 s.

To sum up, in this implementation, the timing controller TCON controls the data signal terminal Source to input the data signal DATA, which has a voltage equal to the voltage at the common voltage signal terminal Vcom at the same timing, to the data line Data, and the data signal is inputted to the pixel electrode when the pixel is turned on, so that there is no voltage difference between the common electrode and the pixel electrode, pixel polarization can be avoided, and in turn, the image sticking and flicker can be avoided, the quality of display can be improved, and the lifespan of components in the display device can be extended.

Figure 5:
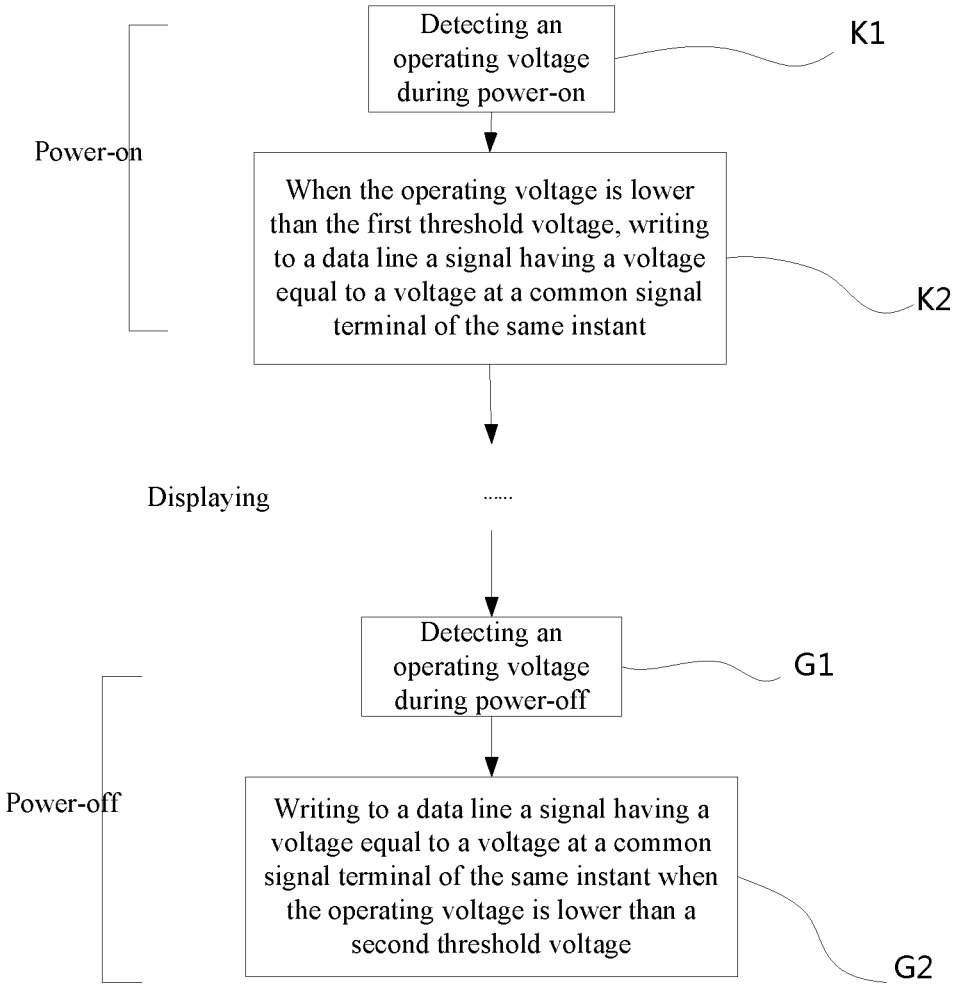
FIG. 5 is a flowchart of a method for eliminating image sticking during power-on and power-off in some embodiments of the present disclosure.

FIG. 5 is a flowchart of a method for eliminating image sticking during power-on and power-off in some embodiments of the present disclosure. As illustrated in FIG. 5, in this implementation, the method for eliminating image sticking during power-on and power-off comprises steps K1 to K2 and/or steps G1 to G2 provided below.

In step K1, an operating voltage is detected during power-on.

During power-on, the Xao module detects a magnitude of the operating voltage VDD; the Xao module outputs a low level when the operating voltage VDD is lower than a first threshold voltage, and the Xao module outputs a high level when the operating voltage VDD is higher than the first threshold voltage.

In step K2, when the operating voltage is lower than the first threshold voltage, a signal, which has a voltage equal to a voltage at a common voltage signal terminal at the same timing, is written to a data line.

During power-on, the operating voltage VDD is gradually increased from zero to a normal voltage that is higher than the first threshold voltage. In a first period of power-on, the operating voltage VDD is lower than the first threshold voltage; in this case, a signal, which has a voltage equal to a voltage at a common voltage signal terminal Vcom at the same timing, is written to a data line until the operating voltage VDD is higher than the first threshold voltage.

Figure 6:
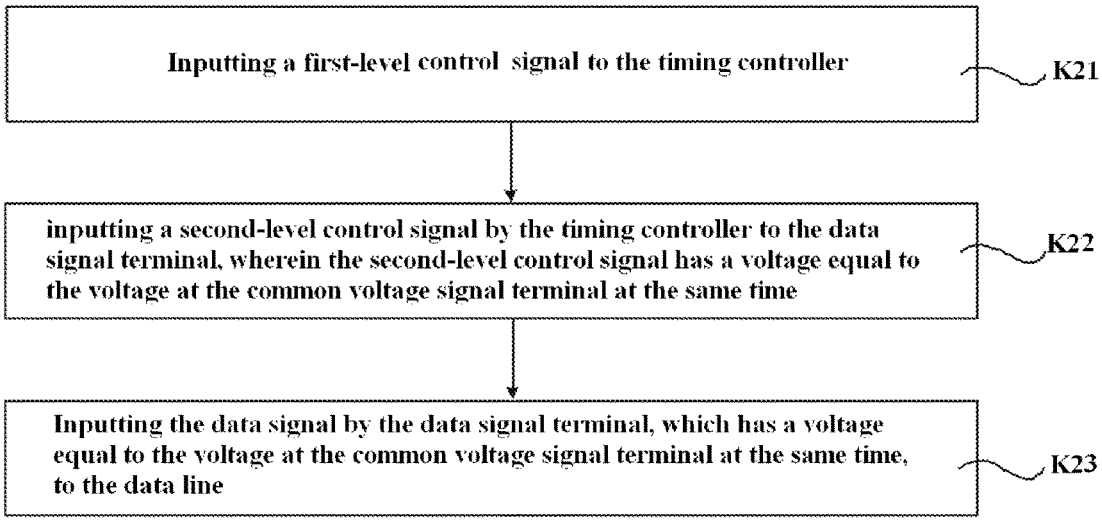
FIG. 6 is a flowchart of writing a signal to a data line during power-on of a display device provided in some embodiments of the present disclosure.

Specifically, inputting the signal, which has a voltage equal to the voltage at the common voltage signal terminal Vcom at the same timing, to the data line Data can be implemented by conducting the path between the data line Data and the common voltage signal terminal Vcom. In addition, as illustrated in FIG. 6, it is also possible to implement inputting the signal, which has a voltage equal to the voltage at the common voltage signal terminal Vcom at the same timing, to the data line Data through steps K21 to K23 provided below.

In step K21, a first-level control signal is inputted to a timing controller TCON.

In step K22, a second-level control signal is output from the timing controller TCON to the data signal terminal Source, wherein a voltage of the second-level control signal is equal to the voltage at the common voltage signal terminal Vcom at the same timing.

In step K23, a data signal, which has a voltage equal to the voltage at the common voltage signal terminal Vcom voltage at the same timing, is output from the data signal terminal Source to the data line Data.

Optionally, in step K2, when the time length for which the operating voltage is lower than the first threshold voltage reaches a first preset time length, a data signal, which has a voltage equal to the voltage at the common voltage signal terminal at the same timing, is written to the data line. In this way, it is possible to avoid the malfunction due to the jitter of the operating voltage VDD, which might be identified as a power-on or power-off process, during the normal displaying, system robustness can be improved.

In step G1, the operating voltage is detected during power-off.

The operating voltage VDD is gradually decreased during the power-off, and it is decreased from a normal voltage higher than the second threshold voltage to zero. At a certain moment during power-off, the operating voltage VDD will be lower than the second threshold voltage; at this moment, a signal, which has a voltage equal to a voltage at a common voltage signal terminal Vcom at the same timing, is written into the data line Data, until the operating voltage VDD is decreased to zero.

In step G2, a data signal, which has a voltage equal to a voltage at a common voltage signal terminal at the same timing, is written to a data line when the operating voltage is lower than the second threshold voltage.

Figure 7:
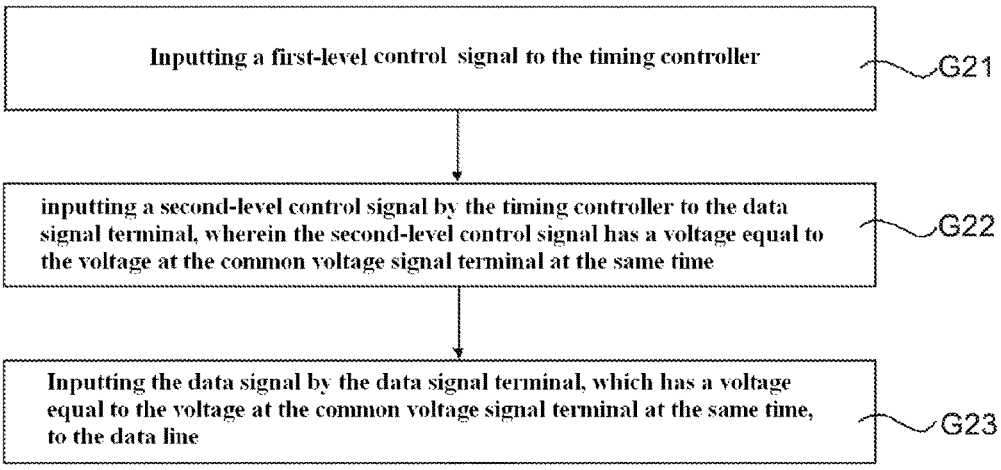
FIG. 7 is a flowchart of writing a signal to a data line during power-off of the display device provided in some embodiments of the present disclosure.

Specifically, inputting a signal, which has a voltage equal to the voltage at the common voltage signal terminal Vcom at the same timing, to the data line Data, can be implemented by conducting the path between the data line Data and the common voltage signal terminal Vcom. In addition, as illustrated in FIG. 7, it is also possible to implement inputting a signal, which has a voltage equal to the voltage at the common voltage signal terminal Vcom at the same timing, to the data line Data through steps G21 to G23 provided below.

In step G21, a first-level control signal is inputted to a timing controller TCON In step G22, a second-level control signal is output from the timing controller TCON to the data signal terminal Source, wherein a voltage of the second-level control signal is equal to the voltage at the common voltage signal terminal Vcom at the same timing.

In step G23, a data signal, which has a voltage equal to the voltage at the common voltage signal terminal voltage at the same timing, is output from the data signal terminal Source to the data line Data.

Optionally, in step G2, when a time length for which the operating voltage is lower than the second threshold voltage reaches a second preset time length, a data signal, which has a voltage equal to the voltage at the common voltage signal terminal at the same timing, is written to the data line. In this way, it is possible to avoid the malfunction due to the jitter of the operating voltage VDD, which might be identified as a power-on or power-off process, during the normal displaying, system robustness can be improved.

To sum up, in the method for eliminating image sticking during power-on and power-off provided by the present disclosure, a signal, which has a voltage that is equal to the voltage at the common voltage signal terminal at the same timing, is written to the data line, so that when the operating voltage is lower than the first threshold voltage during power-on, or the operating voltage is lower than the second threshold voltage during power-off, the voltage on the pixel electrode and the voltage on the common electrode are equal to each other, and the voltage difference there between is eliminated; thus, pixel polarization can be avoided, and in turn, the image sticking and flicker can be avoided, the quality of display can be improved, and the lifespan of components in the display device can be extended.

It is to be understood that, the implementations described above merely are exemplary implementations of the present disclosure adopted to illustrate the principle of the present disclosure, but the protection scope of the present disclosure is not limited thereto. A person of ordinary skill in the art can make various variants and improvements without departing from the scope and substance of the present disclosure, these variants and improvements are also considered as failing into the protection scope of the present disclosure.

What is claimed is:

1. A circuit for eliminating image sticking of a display device during power-on and power-off, comprising:

a voltage detecting module configured to detect whether an operating voltage is lower than a first threshold voltage during the power-on of the display device, and detect whether the operating voltage is lower than a second threshold voltage during the power-off of the display device; and a common signal writing module configured to, when the operating voltage is lower than the first threshold voltage during the power-on of the display device or the operating voltage is lower than the second threshold voltage during the power-off of the display device, write to a data line a signal, which has a voltage equal to a voltage at a common voltage signal terminal at the same timing, wherein the common signal writing module comprises a wire connecting the data line to the common voltage signal terminal, and a switch arranged on the wire;

the switch enables a path between the data line and the common voltage signal terminal to conduct when the voltage detecting module detects that the operating voltage is lower than the first threshold voltage during the power-on of the display device; and the switch enables the path between the data line and the common voltage signal terminal to conduct when the voltage detecting module detects that the operating voltage is lower than the second threshold voltage during the power-off of the display device.

2. The circuit of claim 1, wherein the voltage detecting module is an X-driver-all-open module.

3. The circuit of claim 2, wherein the switch is a thin film transistor, wherein a gate of the thin film transistor is connected to the X-driver-all-open module, a source of the thin film transistor is connected to the common voltage signal terminal, and a drain of the thin film transistor is connected to the data line.

4. The circuit of claim 3, wherein the common signal writing module further comprises a resistor and a capacitor; one terminal of the resistor is connected to the common voltage signal terminal, and the other terminal of the resistor is connected to the source of the thin film transistor and a first terminal of the capacitor; the first terminal of the capacitor is further connected to the source of the thin film transistor, and a second terminal of the capacitor is grounded.

5. The circuit of claim 1, wherein the common signal writing module further comprises a timing controller;

when the voltage detecting module detects that the operating voltage is lower than the first threshold voltage during the power-on of the display device or detects that the operating voltage is lower than the second threshold voltage during the power-off of the display device, the voltage detecting module is configured to output a first-level control signal to the timing controller, wherein the first-level control signal is a digital signal;

the timing controller is configured to output a second-level control signal to a data signal terminal according to the first-level control signal, wherein the second-level control signal is an analog signal with a voltage equal to the voltage at the common voltage signal terminal at the same timing; and the data signal terminal is configured to output a data signal, which has a voltage equal to the voltage at the common voltage signal terminal at the same timing, to the data line according to the second-level control signal.

6. The circuit of claim 5, wherein the voltage detecting module further comprises a timer configured to calculate a time length for which the operating voltage is lower than the first threshold voltage during the power-on, and calculate a time length for which the operating voltage is lower than the second threshold voltage during the power-off;

when the time length for which the operating voltage is lower than the first threshold voltage during the power-on reaches a first preset time length, or when the time length for which the operating voltage is lower than the second threshold voltage during the power-off reaches a second preset time length, the voltage detecting module is configured to send a signal to the common signal writing module, so that the common signal writing module starts to write a signal to the data line.

7. The circuit of claim 1, wherein the voltage detecting module further comprises a timer configured to calculate a time length for which the operating voltage is lower than the first threshold voltage during the power-on, and calculate a time length for which the operating voltage is lower than the second threshold voltage during the power-off;

when the time length for which the operating voltage is lower than the first threshold voltage during the power-on reaches a first preset time length, or when the time length for which the operating voltage is lower than the second threshold voltage during the power-off reaches a second preset time length, the voltage detecting module is configured to send a signal to the common signal writing module, so that the common signal writing module starts to write a signal to the data line.

8. The circuit of claim 7, wherein values of the first preset time length and the second preset time length both are in a range of 5 milliseconds to 1 second.

9. The circuit of claim 1, wherein the first threshold voltage is equal to the second threshold voltage.

10. A method for eliminating image sticking of a display device during power-on, comprising:

a detecting step of detecting an operating voltage during the power-on of the display device; and a writing step of, when the operating voltage is lower than a first threshold voltage, writing to a data line a signal, which has a voltage equal to a voltage at a common voltage signal terminal at the same timing, wherein, during the writing step, an switch enables a path between the data line and the common voltage signal terminal to conduct when the operating voltage is lower than the first threshold voltage during the power-on of the display device.

11. The method of claim 10, wherein in the writing step, when a time length for which the operating voltage is lower than the first threshold voltage reaches a first preset time length, a signal, which has a voltage equal to the voltage at the common voltage signal terminal at the same timing, is written to the data line.

12. The method of claim 10, wherein a path between the data line and the common voltage signal terminal conducts in the writing step.

13. The method of claim 10, wherein the writing step comprises:

inputting a first-level control signal to a timing controller;

inputting, by the timing controller, to the data signal terminal a second-level control signal, a voltage of the second-level control signal being equal to the voltage at the common voltage signal terminal at the same timing; and inputting, by the data signal terminal, to the data line a data signal with a voltage equal to the voltage at the common voltage signal terminal voltage at the same timing.

14. The method of claim 13, wherein the first-level control signal is a digital signal, and the second-level control signal is an analog signal.

15. The method of claim 10, wherein a value of the first preset time length is in a range of 5 milliseconds to 1 second.

16. A method of eliminating image sticking of a display device during power-off, comprising:

a detecting step of detecting an operating voltage during the power-off of the display device; and a writing step of writing to a data line a signal, which has a voltage equal to a voltage at a common voltage signal terminal at the same timing, when the operating voltage is lower than a second threshold voltage, wherein, during the writing step, an switch enables the path between the data line and the common voltage signal terminal to conduct when the operating voltage is lower than the second threshold voltage during the power-off of the display device.

17. The method of claim 16, wherein in the writing step, when a time length for which the operating voltage is lower than the second threshold voltage reaches a second preset time length, a signal, which has a voltage equal to the voltage at the common voltage signal terminal at the same timing, is written to the data line.

18. The method of claim 16, wherein in the writing step, a path between the data line and the common voltage signal terminal conducts.

19. The method of claim 16, wherein the writing step comprises:

inputting a first-level control signal to a timing controller;

inputting, by the timing controller, to a data signal terminal a second-level control signal, a voltage of the second-level control signal being equal to a voltage at the common voltage signal terminal at the same timing; and inputting, by the data signal terminal, to the data line a data signal with a voltage equal to the voltage at the common voltage signal terminal at the same timing.

* * * * *